US007525409B2

(12) United States Patent
Öberg et al.

(10) Patent No.: US 7,525,409 B2
(45) Date of Patent: Apr. 28, 2009

(54) METHOD OF MANUFACTURING A VARISTOR

(75) Inventors: Åke Öberg, Uppsala (SE); Peter Hidman, Smedjebacken (SE); Ragnar Österlund, Ludvika (SE); Leif Pettersson, Västerås (SE)

(73) Assignee: ABB Research Ltd., Zürich (CH)

( * ) Notice: Subject to any disclaimer, the term of this patent is extended or adjusted under 35 U.S.C. 154(b) by 135 days.

(21) Appl. No.: 11/793,607

(22) PCT Filed: Nov. 28, 2005

(86) PCT No.: PCT/SE2005/001784

§ 371 (c)(1),
(2), (4) Date: Jun. 20, 2007

(87) PCT Pub. No.: WO2006/068570

PCT Pub. Date: Jun. 29, 2006

(65) Prior Publication Data

US 2008/0129442 A1 Jun. 5, 2008

(30) Foreign Application Priority Data

Dec. 22, 2004 (SE) ..... 0403170

(51) Int. Cl.
*H01C 7/00* (2006.01)

(52) U.S. Cl. ..... 338/21; 338/20; 29/610.1; 252/518.1; 361/124

(58) Field of Classification Search ..... 338/20, 338/21, 275; 29/610.1, 610 R; 252/518–520; 361/124–126

See application file for complete search history.

(56) References Cited

U.S. PATENT DOCUMENTS

| | | | | |
|---|---|---|---|---|
| 4,371,860 | A * | 2/1983 | May et al. | 338/21 |
| 5,610,570 | A * | 3/1997 | Yamada et al. | 338/20 |
| 6,199,268 | B1 | 3/2001 | Greuter et al. | |
| 6,211,770 | B1 * | 4/2001 | Coyle | 338/21 |
| 6,342,828 | B1 * | 1/2002 | Hagemeister et al. | 338/20 |

FOREIGN PATENT DOCUMENTS

| | | | |
|---|---|---|---|
| EP | O 0275151 | A2 | 1/1993 |
| GB | 1508327 | A | 4/1978 |
| GB | 2106714 | A | 4/1983 |
| WO | WO-89/10813 | A1 | 11/1989 |

OTHER PUBLICATIONS

K. Donnelly et al.; AC Conductivity Effect of Non-linear Fillers in Electrical Insulation; IEEE; 2000; pp. 132-135.
PCT/ISA/210-International Search Report-Mar. 3, 2006.
PCT/ISA/237-Written Opinion of the International Searching Authority- Mar. 3, 2006.

* cited by examiner

*Primary Examiner*—Kyung Lee
(74) *Attorney, Agent, or Firm*—Venable LLP; Eric J. Franklin

(57) ABSTRACT

A varistor including a varistor body with two parallel end faces made of a material that contains one or more metal oxides, and at least one electrode made of an electrically conductive electrode material arranged on any of the end faces of the varistor body. The electrode includes a layer of electrode material coated on the end face by means of an ion- or atom-transferring method, whereby the layer has a thickness within the interval of from 5 micrometers to 30 micrometers.

14 Claims, 2 Drawing Sheets

METHOD OF MANUFACTURING A VARISTOR

CROSS-REFERENCE TO RELATED APPLICATIONS

This application claims priority to Swedish patent application 0403170-4 filed 22 Dec. 2004 is the national phase under 35 U.S.C. § 371 of PCT/SE2005/001784 filed 28 Nov. 2005.

TECHNICAL FIELD

The present invention relates to a varistor comprising a varistor body with two parallel end faces made of a material that contains one or more metal oxides, and at least one electrode made of an electrically conductive electrode material arranged on any of the end faces of the varistor body. Such a varistor may be used in a variety of electrical applications, for example as overvoltage protective device in electric networks, but also for electronics and computers. A varistor of this kind is particularly well suited for use in a surge arrester.

BACKGROUND ART

A varistor has the property that the resistance is high at low voltage but low at high voltage. A varistor comprises a varistor body, which is usually cylindrical, with two parallel end faces. The end faces are provided with electrodes for contacting and current distribution. These electrodes are in the form of a layer of electrode material. The layer may consist of aluminium or zinc or another metal. The layer may also consist of a conductive ceramic, as is clear from WO 8910813.

To carry large currents through the varistor body, the current has to be distributed as uniformly as possible over the end faces. For this, the properties of the layer play a major roll.

The varistor body is formed, for example, by pressing metal oxide powder, whereupon the pressed body is sintered, preferably in the temperature interval of 1100-1300° C. for about 2-10 h.

After the sintering, the end faces of the varistor body are usually ground or lapped.

After the grinding, the end faces of the varistor body are coated with a layer of electrode material. The detailed shape of the layer is determined by the risk of flashover or damage due to skin effect.

Layers of electrode material are usually applied to the end faces of the varistor bodies by metallizing, preferably by arc spraying or flame spraying of aluminium or zinc. The thickness of the layer is usually about 50 micrometers. Layers of electrode material, which have been applied according to the above-mentioned methods, are characterized by inhomogeneities, thickness variations, a relatively high contact resistance, a high surface roughness, difficulties with the corrosion resistance, and internal stresses at the boundary layer.

It is known that relatively thin layers of gold, on experimental samples of polymer material containing ZnO as filler, have been coated by sputtering (see AC Conductivity Effects of Non-linear Fillers in Electrical Insulation, 2000 Conference on Electrical Insulation and Dielectric Phenomena, p. 133. This method, which is not related to a polymer material with a filler, has not yet been commercialized.

GB 1508327 describes a varistor with several input connections, the purpose of which is to provide protection against voltage transients in polyphase circuits. The cylindrical varistor body contains diametrical sections in one end face, forming "segments" of varistors which are contacted by electrodes applied, for example, by means of sputtering. One disadvantage of such a varistor is that is has limited current and energy absorption capability.

The capacity to withstand repeated electrical loads, for example impulse currents for periods of about 4-20 μs, without breaking down is referred to as the high-current capability. This is described, for example, in the U.S. Pat. No. 6,199,268 B1.

This skin effect adjacent to the periphery of the layer may lead to local overheating of said varistor, and hence to failure, by electrothermal instability. The capacity to withstand high impulse currents for periods of the order of magnitude of 0.5 ms or longer without breaking down is referred to as the energy absorption capability.

OBJECTS OF THE INVENTION

It is a main object of the present invention to suggest a varistor that has improved high-current capability and energy absorption capability as well as a method for manufacture thereof. In this way, the physical size of the varistor may be reduced, as well as the size of the apparatus of which it forms a part, at a given power level. Alternatively, the varistor may handle a larger power at a given size and the apparatus of which it forms a part may be manufactured in an economically more advantageous manner than according to the prior art.

It is another object of the present invention to offer a varistor, and a method for manufacture thereof, which provides less variation of performance than prior art methods.

SUMMARY OF THE INVENTION

The above-mentioned objects may be achieved with a method. The method according to the invention is characterized in that at least one electrode is applied, by means of an ion- or atom-transferring method, to the end face of a varistor body in such a way that the layer thickness of said electrode is within a tested interval. Surprisingly, experiments and investigations have proved that an improvement of the current and energy absorption capability is achieved with a layer of a thickness of from 5 to 30 micrometers, and that a considerable improvement is achieved with a layer of a thickness of from 10 to 20 micrometers. A layer in the thickness interval stated gives good adhesion, high mechanical stability and insignificant propensity for thermal cracking while at the same time giving a good current distribution, which contributes to improved current capability and energy absorption capability. Because of the improved adhesion in the thickness interval stated, less variation in performance is also obtained.

By an ion- or atom-transferring method is meant a method which results in atoms, or ions, being moved from a so-called target, or another source of material, to the surface that is to be coated. Examples of ion- or atom-transferring methods are magnetron sputtering, ion beam sputtering, DC (glow discharge) sputtering, and radio frequency (RF) sputtering, which all belong to the group of methods called physical vapour deposition (PVD). Time, temperature, vacuum pressure level and location are chosen such that the layer will have a thickness within the thickness interval stated above. The coating time is dependent on the speed of coating, which in its turn is dependent on which process equipment is used. A requirement is that the temperature should not exceed 400° C. A suitable temperature interval is 90 to 180° C. The vacuum pressure should not exceed $5 \cdot 10^{-3}$ torr. A suitable interval is $10^{-4}$ to $10^{-6}$ torr. The target or other source of material is chosen such that the layer will have the composition aimed at.

Another ion- or atom-transferring method is also chemical vapour deposition (CVD), wherein ions or atoms are supplied in gaseous state.

Investigations of the layers have shown that the surface fineness according to the definition (see e.g. S. Jacobsson and S. Hogmark, Tribologi, Karleboserien, Liber Utbildning AB, Arlöv 1996, p. 16)

$$R_a = 1/L \cdot \int |z(x)| dx \text{ with a lower limit } x=0 \text{ and an upper limit } x=L$$

for a layer coated with an ion- or atom-transferring method is less than 3 micrometers, whereas a layer coated by a different method, for example by flame spraying or arc spraying, has the surface fineness $R_a$ larger than 8 micrometers. An advantage of an ion- or atom-transferring method is that the effective contact surface becomes considerably larger for a layer coated by means of such a method.

The layer thickness is measured as the difference between the outer surface of the layer, taking into account the mean deviation $R_a$, and the lower surface of the layer, contacting the varistor body, taking into account the mean deviation $R_a$ for this surface.

According to a preferred embodiment of the method described, a closer layer thickness interval is used, being between 10 and 20 micrometers, which provides further improved properties and less variation in performance.

The above object can also be achieved by a varistor.

Since metals in general have good conductivity and a certain workability, they are suitable as electrode material for the layer. Aluminium, or alloys thereof, may advantageously be used because of its good electrical and thermal conductivity. Conductive ceramics generally have the advantage of being oxidation-resistant and hence have less propensity for corrosion, which results in good contacting capacity and good electrical conductivity being maintained. Electrically conductive ceramics are therefore advantageous as electrode material for said layer.

In one proposed embodiment of the method, the surface of the varistor body is ground before coating of the layer is performed. In this way, the adhesion between the layer and the end face of the varistor body is further increased. Alternative methods to grinding, which provide similar advantageous results, are lapping, wet-chemical etching, dry etching/ion sputtering, and laser machining.

In another preferred embodiment of the method, a region with a width of from 0.01 millimeters to 6 millimeters, along the edge of the end face, is left uncoated. It prevents skin effect in the electrode at the edge of the end face and provides improved current capability and higher energy absorption capability.

In still another embodiment of the method, the edge of the end face is bevelled after coating of the layer has been performed. The bevel prevents skin effect at the edge of the end face. The bevel is performed such that an angle arises between the end face and that surface which constitutes the surface of the bevel. The angle may, for example, be in the interval of from 110° to 165°. The bevel may also consist of two or more partial bevels or be made fully rounded.

In yet another embodiment of the method, bevelling of the edge of the end face is combined with a region, with a width of from 0.01 millimeters to 6 millimeters, that has been left uncoated.

The method described above may be used for the whole voltage range from, for example, a few mV to 800 kV or more. The method may be used in overvoltage protective devices for electronic equipment and computers as well as in electric power networks.

One advantageous use of the invention is as voltage protection at high voltages, exceeding a peak voltage of 50 kV, when the good adhesive properties and the low variation in performance of the layer are particularly valuable.

A varistor according to the invention is especially useful in surge arresters

BRIEF DESCRIPTION OF THE DRAWINGS

The present invention will now be described in greater detail by means of different embodiments and with reference to the accompanying drawing.

DESCRIPTION OF THE PREFERRED EMBODIMENT

Figure 1:
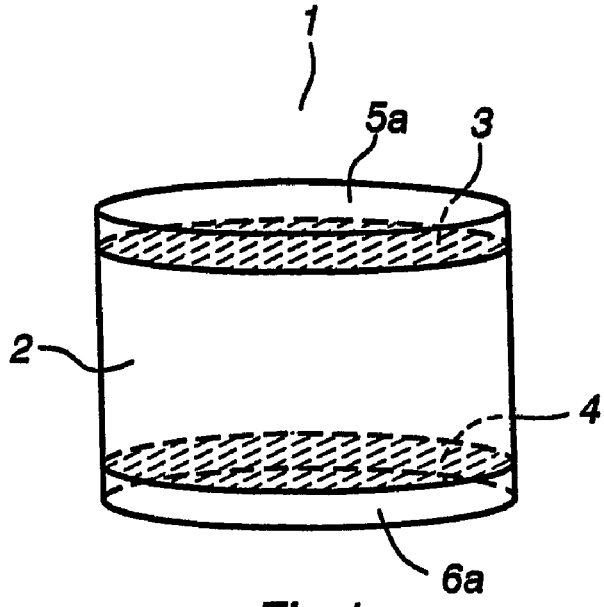
FIG. 1 is a perspective view of a varistor according to the invention.

FIG. 1 shows a varistor 1 according to one embodiment of the invention. The varistor comprises a varistor body 2 with two parallel end faces 3, 4 made of a material that contains one or more metal oxides, for example zinc oxide, and two electrodes arranged on the end faces of the varistor body. Each of the electrodes comprises a layer of electrode material 5, 6, for example aluminium, coated on the end face by means of an ion- or atom-transferring method, for example magnetron sputtering. In this embodiment, this layer has a thickness of about 15 micrometers.

The varistor 1 is manufactured by sintering a varistor body 2, at about 1150° C., of a powder body formed by pressing and containing substantially zinc oxide and minor quantities of other metal oxides. The end faces 3, 4 of the varistor body are pre-treated by grinding, whereupon the electrodes comprising the layers 5, 6 of aluminium are applied to the end faces of the varistor body by magnetron sputtering. The coating is applied, in this embodiment, for about 30 minutes at a temperature of about 125° and at a vacuum pressure of $5 \cdot 10^{-5}$ torr.

Figure 2:
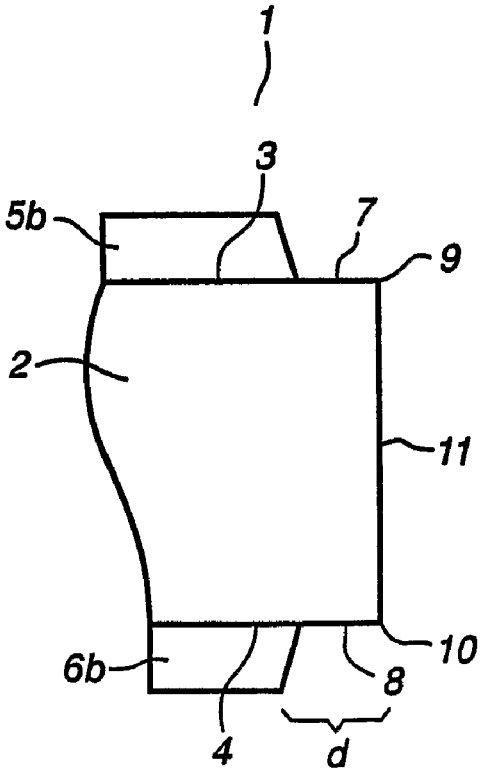
FIG. 2 is an axial cross section through a varistor according to one embodiment of the invention, wherein the layer does not cover the end face in an edge zone.

FIG. 2 shows a varistor 1 according to one embodiment of the invention comprising a cylindrical varistor body 2 with two parallel end faces 3, 4 which are coated with the layers 5*b*, 6*b* only partly, by covering parts of the end faces with masks. According to this embodiment, a region 7, 8 with a width d of about 1 mm along the edge 9, 10 of the end face remains uncoated.

Figure 3:
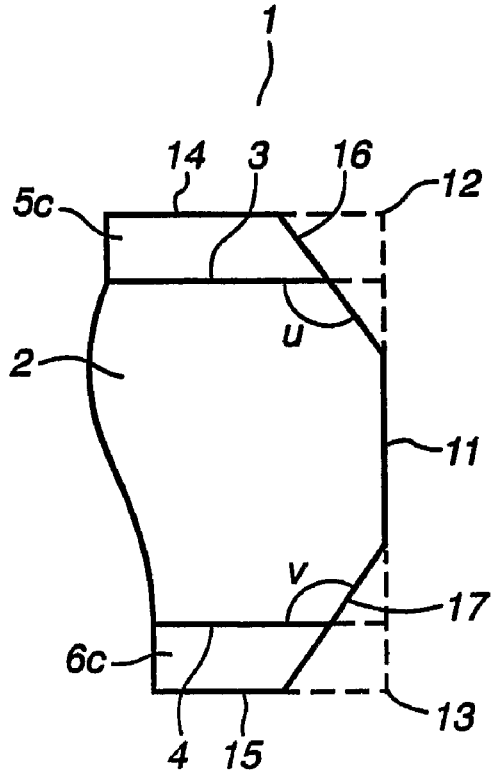
FIG. 3 is an axial cross section through a varistor according to another embodiment of the invention, wherein the edge between the end face of the varistor and the envelope surface thereof has been bevelled.

FIG. 3 shows a varistor 1 according to one embodiment of the invention comprising a cylindrical varistor body 2 with two parallel end faces 3, 4 which are coated with the layers 5*c*, 6*c*. Prior to the coating, the end faces were treated by grinding. The edges 12, 13 between the end faces 14, 15 of the varistor and the cylindrical envelope surface 11 were bevelled. The bevel 16, 17 is achieved by grinding. The angles u and v are in both cases 135°.

Figure 4A:
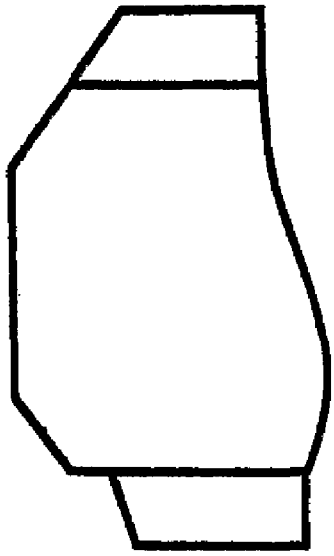
FIGS. 4*a* to 4*d* are axial cross sections with alternative embodiments for the region around the edge between the end face and the envelope surface of the varistor body.

FIG. 4*a* shows a varistor according to one embodiment of the invention comprising a cylindrical varistor body with two parallel end faces which are coated with layers. This embodiment differs from that in FIG. 3 in that one end face has only been partly coated since a region along the edge of the end face has been covered with a mask. After the coating, this end face has been bevelled. The other end face has been fully coated with a layer, whereupon the edge has been bevelled.

Figure 4B:
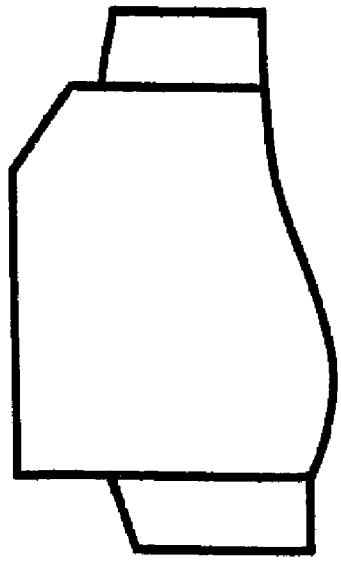

FIG. 4*b* shows a varistor according to one embodiment of the invention comprising a cylindrical varistor body with two parallel end faces which are coated with layers. Both end faces have only been partly coated since a region along the edge of the end face has been covered with a mask. This embodiment differs from that according to FIG. 4*a* in that only one end face has been bevelled and in that both end faces have only been partly covered since a region along the edges of the end faces has been covered with masks.

Figure 4C:
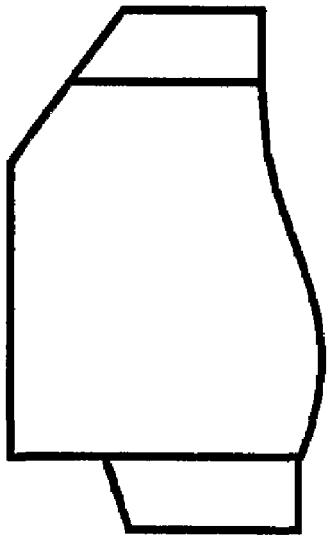

FIG. 4*c* shows a varistor according to one embodiment of the invention comprising a cylindrical varistor body with two parallel end faces which are coated with layers. One end face has only been partly coated since a region along the edge of the end face has been covered with a mask. The other end face has been fully coated with a layer, whereupon the edge has been bevelled. The embodiment according to FIG. 4*c* differs from that according to FIG. 4*a* in that the edge of that end face which has only been partly coated has no bevel.

Figure 4D:
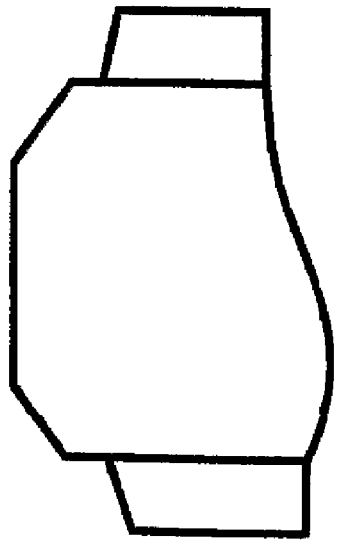

FIG. 4*d* shows a varistor according to one embodiment of the invention comprising a cylindrical varistor body with two parallel end faces which are coated with layers. Both end faces have only been partly coated since a region along the edges of the end faces has been covered with a mask. After the coating, both end faces have been bevelled. The embodiment according to FIG. 4*d* differs from that according to FIG. 4*b* in that the edges of both end faces have been bevelled.

The technical effect of the invention was verified by the following experiment. Varistors with the diameter 62 mm and the height 42.5 mm in a number of 18 were manufactured in accordance with the invention, wherein the end faces, after having been pre-treated by grinding, were fully coated with aluminium. In a control group, which also comprised 18 varistors, the electrodes of aluminium were applied according to the prior art by arc spraying. The varistors were subjected to a test which started with three current impulses for one minute, whereupon the varistors were cooled to room temperature. After this, they were again subjected to three current impulses for one minute with an ensuing cooling operation to room temperature. The procedure was repeated until the varistors had been subjected to 21 current impulses each. The current in each of the impulses, to which each of the varistors was subjected, was 770 A. All of the varistors, which had been manufactured in accordance with the invention, and all of the varistors in the control group withstood the test without being damaged.

After the test series with current impulses at the level of 770 A, a second series was carried out according to the same procedure but at the level 1200 A. Also the second test series comprised a total of 21 current impulses. Of the varistors that had been made in accordance with the invention, 16 out of 18 withstood the test without being damaged, but in the control group only two out of 18 remained undamaged.

The conclusion is that the varistors that were manufactured according to the invention had a significantly improved energy absorption capability compared with those manufactured according to the prior art.

According to another embodiment of the invention, a varistor may be manufactured by pretreating the end faces of the varistor body by dry etching/ion sputtering, whereupon the electrodes comprising the layers of aluminium are applied to the end faces of the varistor body by DC (glow discharge) sputtering.

According to a further embodiment of the invention, a varistor may be manufactured by pretreating the end faces of the varistor body by dry etching/ion sputtering, whereupon the electrodes comprising the layers of aluminium are applied to the end faces of the varistor body by ion beam sputtering.

According to still another embodiment of the invention, a varistor may be manufactured by pretreating the end faces of the varistor body by wet-chemical etching, whereupon the electrodes comprising the layers of aluminium are applied to the end faces of the varistor body by RF (radio frequency) sputtering.

The invention claimed is:

1. A method of manufacturing a varistor, the method comprising:

manufacturing a varistor body with two end faces based on one or more metal oxides, coating at least one end face of the varistor body with a layer of electrode material, wherein said electrode material contains aluminum or an alloy thereof and coating is performed by means of an ion- or atom-transferring method, whereby conditions during the coating are adapted such that the thickness of the layer is within the interval of from 5 micrometers to 30 micrometers.

2. The method according to claim 1, wherein the conditions during the coating are adapted such that the thickness of the layer is within the interval of from 10 micrometers to 20 micrometers.

3. The method according to claim 1, further comprising:

pretreating said end face prior to the coating with the layer to increase the adhesion between the layer and the end face of the varistor body.

4. The method according to claim 3, wherein said end face prior to the coating with the layer is pretreated by grinding.

5. The method according to claim 3, wherein said end face prior to the coating with the layer is pretreated by wet-chemical etching.

6. The method according to claim 3, wherein said end face prior to the coating with the layer is pretreated by dry etching/ion sputtering.

7. The method according to claim 1, wherein said end face is surrounded by an edge, and wherein said end face is prevented from being coated with a layer so that a region, with a width of from 0.01 to 6.0 mm, along the edge of the end face remains uncoated.

8. The method according to claim 1, wherein said end face is surrounded by an edge, whereby the edge is bevelled after the coating of the layer.

9. A varistor, comprising:

a varistor body including two parallel end faces made of a material that contains one or more metal oxides, and at least one electrode made of an electrically conductive electrode material arranged on any of the end faces of the varistor body, wherein said electrode comprises a layer of aluminum or an alloy thereof coated on the end face by means of an ion- or atom-transferring method, whereby said layer has a thickness within the interval of from 5 micrometers to 30 micrometers.

10. The varistor (1) according to claim 9, characterized in that said layer has a thickness within the interval of from 10 micrometers to 20 micrometers.

11. The varistor according to claim 9, wherein said end face is surrounded by an edge that has an extent that is smaller than the extent of the end face, whereby the end face has a region with no coating of electrode material along the edge, said uncoated region having a width of from 0.01 mm to 6.0 mm.

12. The varistor (1) according to claim 9, wherein said end face is surrounded by a bevelled edge.

13. Use of a varistor according to claim 9, in an electrical protective application where the peak voltage exceeds 50 kV.

14. Use of a varistor according to claim 9, in a surge arrester.

* * * * *